United States Patent [19]

Berger

[11] Patent Number: 4,747,814

[45] Date of Patent: May 31, 1988

[54] FIBER SEPARATOR

[75] Inventor: Richard M. Berger, Midlothian, Va.

[73] Assignee: American Filtrona Corporation, Richmond, Va.

[21] Appl. No.: 888,211

[22] Filed: Jul. 23, 1986

[51] Int. Cl.[4] ..... A24D 3/02; B65G 53/52; B65H 51/16

[52] U.S. Cl. ..... 493/44; 493/48; 156/441; 226/97; 406/46; 406/191

[58] Field of Search ..... 493/44, 48; 156/180, 156/441; 226/97; 406/46, 83, 84, 191

[56] References Cited

U.S. PATENT DOCUMENTS

| | | | |
|---|---|---|---|
| 495,359 | 4/1893 | McClaue | 406/46 |
| 1,272,794 | 7/1918 | Girtanner | 406/191 |
| 3,095,343 | 6/1963 | Berger | 156/180 |
| 3,127,080 | 3/1964 | Allander et al. | 226/97 |
| 3,224,814 | 12/1965 | Fisher | 406/191 |
| 3,313,306 | 4/1967 | Berger et al. | 131/10.07 |
| 3,313,665 | 4/1967 | Berger | 156/180 |
| 3,334,161 | 8/1967 | De Guzman | 226/97 |
| 3,377,220 | 4/1968 | Berger et al. | 156/62.2 |
| 3,380,783 | 4/1968 | Hunter | 406/191 |
| 3,405,977 | 10/1968 | Albright | 406/84 |
| 3,917,141 | 11/1975 | Sartori | 229/97 |
| 4,069,961 | 1/1978 | Nicklaus et al. | 226/97 |
| 4,390,031 | 6/1983 | Berger | 131/336 |

*Primary Examiner*—Frederick R. Schmidt
*Assistant Examiner*—William E. Terrell
*Attorney, Agent, or Firm*—Holmes & Stern

[57] ABSTRACT

Apparatus is disclosed for use in the manufacture of rod like elements, for example cigarette filters formed of filamentary tow, for dissipating conveying gas from a conduit through which the tow is conveyed pneumatically through a series of processing stations. To effectively dissipate the gas from the conduit, the invention provides axially spaced rings of gas dissipation ports in the conduit. The ports in the upstream rings are inclined rearwardly to provide gas dissipation in a direction which is counter-current the direction of travel of the tow through the conduit. The ports in adjacent rings are offset circumferentially so as to improve the distribution of ports around the circumference of the conduit in the section used for gas dissipation.

4 Claims, 1 Drawing Sheet

FROM AIR JET ASSEMBLY
10A
A
12A
12B
12C
12D
12E
12F
12G
12H
12J
12K
12L
12M
12N
14A
14B
14C
10
10B
AIR DISSIPATION
STEAM ADMISSION
4°

FIBER SEPARATOR

BACKGROUND OF THE INVENTION

This invention relates to a fiber separator, alternatively referred to as gas dissipation apparatus, primarily for use in the manufacture of filter means, more particularly tobacco smoke filter elements, although the same device may be useful in dissipating excess air in the manufacture of other products which are pneumatically conveyed, such as reservoir elements for felt tip pens or the like. More specifically, the instant inventive concepts are primarily concerned with the manufacture of elongated rods such as filter means for cigarettes, although the apparatus of this invention is generally useful in other applications including reservoir elements and filters for tobacco smoking means, whether they be cigarettes, cigars, pipes or the like. Since filters for cigarettes are particularly commercially important, the basic embodiments of the instant invention will be discussed as they relate to the production of filtered cigarettes.

In making tobacco smoke filters for use in connection with cigarettes and the like, bondable continuous filamentary tows of substantially continuous thermosplastic fibers, such as plasticized cellulose acetate fibers, polyethylene fibers, polypropylene fibers, nylon fibers and the like, have conventionally been employed as the starting material. The term "continuous filamentary tow", as used in this specification and the appended claims, is intended to define a material such as that which results when filaments extruded from a plurality of spinnerets are brought together and combined to form a continuous body of fibers randomly oriented primarily in a longitudinal direction. In such a tow, the filaments are generally longitudinally aligned in substantially parallel orientation, but include crimped portions which may form short sections running more or less at random in non-parallel diverging and converging directions. Although the apparatus of this invention is applicable to the various filamentary materials of this type, since plasticized cellulose acetate is the most common thermoplastic fibers used in the manufacture of cigarette filters, the specification hereof will be generally set forth in terms of this material. However, it is to be understood that the instant inventive concepts are not to be limited to this preferred embodiment.

In the manufacture of filters for cigarettes and the like, a number of different factors must be considered. Filtration efficiency, which is the capacity to remove unwanted constituents from smoke, while highly desirable is only one factor important in producing a commercially acceptable filter. Other factors, such as pressure drop, taste, hardness and cost also determine commercial acceptance of these products. For example, cellulose acetate, one of the most commonly used substances in manufacturing cigarette filters has a relatively low filtration efficiency. Increased filtration efficiency obtained by increasing the density or length of a cellulose acetate filter may cause a pressure drop across the filter which is excessively and commercially unacceptable. The use of activated carbon or other such materials having higher filtration efficiency may increase cost and deleteriously affect taste.

In recent years, air dilution has become a popular technique for compensating for the relatively low filtration efficiency of cigarette filters which have a pressure drop significantly low for commercial acceptance. In this technique, ventilating air is drawn into the filter peripherally and dilutes the smoke stream from the tobacco to thereby reduce the quantity of tar and other unwanted tobacco constituents drawn into the smoker's mouth with each puff.

The air dilution technique provides several obvious advantages:

It is an extremely economical method for reducing various solid phase constituents of tobacco smoke, generally referred to as "tar".

It also enables the removal or reduction of certain gas phase constituents of tobacco smoke such as carbon monoxide and nitrous oxide.

By varying the quantity of air introduced into the filter with each puff, it permits control, within reason, of the filtration process in order that efficiency and taste can be balanced.

One of the major challenges to the cigarette filter industry has been to design a filter and filter production techniques and apparatus for producing, at high speeds, large numbers of low costs filters capable of utilizing the air dilution technique. When the air dilution technique first became commercially important, most cigarette filters were produced with an over-wrap material applied to the outside of the filament bundle comprising the filter element in order to achieve a dimensionally stable product. The manufacturing process produced an axially elongated rod comprising a core of filaments contained by a surrounding over-wrap material called the "plug-wrap". After cutting the filter rods into small segments or plugs suitable for use as cigarette filters, a tipping over-wrap secured the segments to a tobacco column comprising a core of tobacco surrounded by a cigarette paper over-wrap. With the air dilution technique, cigarette filters produced in the foregoing manner required a porous or permeable plug-wrap in order that the air introduced generally through selectively provided perforations in the tipping over-wrap merged with undiluted smoke coming from the tobacco column.

Because the use of plug-wrap has certain disadvantages in general discussed in some detail in U.S. Pat. Nos. 3,313,306 and 3,377,220 granted Apr. 11, 1967 and Apr. 10, 1968, respectively, the subject matter of which is incorporated herein in their entirety by reference, techniques for producing non-wrapped dimensionally stable filter elements were developed. The significance of producing a non-wrapped, dimensionally stable filter rod is even more pronounced for use in air diluted cigarettes in view of the high cost of porous plug-wrap materials.

The techniques for producing a non-wrapped dimensionally stable filter rod disclosed in the aforementioned U.S. patents and related patents commonly assigned with the instant application, are highly useful and were the best way known for such production at the time of their development. In these processes, the filtering material, which may be continuous filamentary tow, staple fibers or particulate in form is carried through the processing apparatus by an endless porous belt through which heated gas, such as steam, and coolant gas, such as air, are passed peripherally into the filtering material to bond the same into a dimensionally stable rod needing no plug-wrap at all. Thus, two advantages are gained from this very desirable method: elimination of the steps involved in applying the plug-wrap itself and the cost of the plug-wrap, the latter being particularly significant when considering the high costs of porous plug-wrap necessary for use in an air-diluted filtered cigarette.

Although the endless belt method for formation of non-wrapped filters has been the subject of wide spread commercial interest, a number of disadvantages exist with respect to its use. The woven nature of the endless belt necessary to provide its porosity to steam and air embosses the surface of the filter rod with the pattern of the belt and leaves loose fibers which render the adhesion of the tipping paper to the filter element less efficient. The forming belt itself interferes with the step of steam penetration necessary to the formation of a dimensionally stable product and reduces the efficiency of the machine because the belts wears out and have to be changed, the belt-changing process resulting in time down for the filter rod production line.

Thus, the elimination of the belt for carrying the filtering material through the various processing stations was desirable for obvious reasons. Yet, the belt was introduced, in part, as explained in the aforementioned patents, to eliminate the need to "pull" the filamentary tow, which is the most desirable commercial filtering material, through the system producing an undesirable tension on the individual filaments and producing a rod with size, shape and functional characteristics which are difficult to control.

A highly desirable alternative to "pulling" the tow through the system or using a belt to "carry" the tow through the system is to "push" the tow through the system. A pneumatic technique for making fibrous bodies has been disclosed in commonly assigned U.S. Pat. No. 3,313,665 granted Apr. 11, 1965, the subject matter of which is also incorporated herein in its entirety. In this technique, air or other feeding gas under pressure is used to "push" the tow through a confined zone where it is heated and cooled to bond the product into a rod. Moreover, this technique enables a reorientation of the individual fibers transversely of the longitudinal dimension of the rod. The process disclosed in U.S. Pat. No. 3,313,665 has found great commercial utility in the production of relatively large diameter "wicking" materials for felt-tip pens and the like, but was found unsuitable for the production of much smaller diameter cigarette filter elements because of the difficulty in dissipating the large volume of air necessary for propelling the fibrous material through the system shown in U.S. Pat. No. 3,313,665. Cigarette filter elements normally have a diameter of about 8 mm in contrast to "wicking" cartridges which are generally well over twice that size in diameter. When the confined zone is relatively large, the feeding gas may be substantially dissipated through a foraminous area of relatively short length due to the large circumference. Yet elimination of at least a major portion of the air prior to introduction of steam or the like is necessary to enable transverse penetration of the steam to the core of the tow for uniform bonding. Extension of the foraminous or porous zone, which is produced by a multiplicity of circumferential holes through the wall of the element defining the confined zone, was undesirable since such holes produce a rough inner surface which catch the tow and cause binding within the processing lines. Once the tow has been contacted with steam it shrinks slightly from the walls of the confined zone and is somewhat lubricated alleviating the foregoing problems. It has been found that application of the pneumatic feeding technique to the production of small diameter rods such as cigarette filter rods can be accomplished if the amount of air can be reduced significantly from that required by prior art techniques to minimize the dissipation problem, a procedure which has not been possible heretofore, and/or if some of the air can be dissipated after steam introduction, a procedure which would result in non-uniform bonding at the core of the tow unless compensation is provided by additional residence time and significant transverse reorientation of the filbers in the presence of the steam prior to introducing cooling gas, in contrast to the almost immediate cooling step of the prior art process. This enhanced residence time is particularly important in the high speed production lines necessary for commercial production of cigarette filter rods, generally well in excess of 75 meters/min and up to about 500 or more meters/min.

Accordingly, a pneumatic feeding technique, as disclosed in U.S. Pat. No. 4,390,031 has been developed for production of the small diameter filter rods. The disclosure of this patent is also expressly incorporated herein by reference. In the process according to U.S. Pat. No. 4,390,031, the filamentary tow is pneumatically conveyed by means of a jet which feeds the conveying gas, preferably air, at a specified angle into a confined chamber. The air is preferably fed annularly around the tow at the entrance end of the confined chamber to produce a venturi effect which draws the continuous filamentary tow into the chamber. The use of a particularly small acute angle of air feed through the jet into the confined chamber, preferably between 0° and 20°, requires a much smaller volume of conveying gas to convey a given amount of filamentary tow than with previously available equipment. Because a much reduced column of conveying gas is used, at least a major portion, and preferably substantially all, of the conveying gas may be conveniently dissipated through a limited porous section of the confined chamber without requiring a cross-section of the chamber so large that the fibrous body formed in the confined chamber cannot be used for a cigarette filter. The pneumatic feed in combination with a reduced take-off cross-section and the cooling zone bends the fibers of the tow perpendicular to the longitudinal axis of the confined chamber. The arrangement of the fibers in the filter thus formed is substantially overlapping and generally transverse to the longitudinal axis of the filter rod being formed. The fibers are cured with steam or other heated gas in this transverse overlapping relationship and the layers of the fiber are even further compacted in a preferred embodiment utilizing an extended steam soaking chamber and reduced cross-section cooling zone, prior to the rod being extruded from the apparatus. Because the formed body is extruded, the filamentary material is in a relaxed state and maintains its crimped shape. Additionally, secondary crimp is imparted to the fibers by extruding the filter rod at a linear rate of feed less that of the incoming tow. Furthermore, the material is forced against the wall of the confined cooling zone of reduced cross-section and thus a precision size and shape of the filter can be easily maintained. The reduced cross-section of the cooling zone bends some of the edges of the filters axially rearward (i.e., about axes generally perpendicular to the filter rod length) to provide a smooth peripheral surface which permits reliable bonding of the wrap material thereto.

Because the product formed by this method is manufactured from continuous fibers in which the folded edges are bent rearwardly, there are substantially no loose ends or fibers exposed on the surface of the filter rod so formed. Significantly, because the process and apparatus makes much more efficient use of the filamentary tow, it may be divided into several portions, and each portion fed to a separate rod-forming station. Additionally, because the filter rod produced by the instantly disclosed process may be bent without breakage, subsequent processing of the filter rod into filter elements may be accomplished at numerous stations arrayed perpendicularly to the outlet end of the rod-forming station. It should, however, be borne in mind, that processing of the filter rods may also be accomplished at stations generally in line with the rod-forming station.

The particular feed jet used in the patented process offers considerable savings in the amount of conveying gas required for manufacture of the filters. A savings of from 50–85% compared to the jet used in prior pneumatic processes has been achieved. Significantly, because the process uses pneumatic means, machine efficiency is increased by elimination of the belt and belt drive apparatus and concomitant maintenance to both required for other non-wrapped filter production techniques.

The process and apparatus disclosed in U.S. Pat. No. 4,390,031 is generally effective in providing pneumatic feed of the small size tow material required for cigarette filters, particularly in regards to gas dissipation prior to steaming, due to the use of a more limited gas supply through the angled, venturi-type gas feed, and a rod surface particularly receptive to tipping due to bending back of at least some of the tow fibers at the edges of the tow. The present invention, however, seeks, inter alia, to improve the process particularly in regard to the tow surface effects.

More particularly, it is an object of the invention to improve the surface characteristics of filter tow by further reducing the tendency of the tow fibers to hang in the apparatus thereby producing undesirable surface roughness and blemishes.

Another object of the invention is to improve the surface characteristics of the tow by providing a more effective means for bending back the tow fibers at the edges.

A further object of the invention is to provide an improved fiber separator (gas dissipation apparatus) for use in pneumatic feed-type manufacturing processes, particularly adapted for effecting the above and other objects.

SUMMARY OF THE INVENTION

The invention provides gas dissipation apparatus for use in the manufacture of filter rod materials for cigarette filters and the like or other pneumatically formed rod-like elements, effective for discharging gas from a conduit through which a tow of fibrous material is conveyed by the gas, the apparatus comprising a conduit element, which may form part of or be connected into the conveying conduit, the conduit element having an inlet end, an outlet end, and plural axially spaced rings of circumferentially spaced gas discharge ports between the inlet and outlet ends, the ports at least in selected rings adjacent the inlet end being inclined rearwardly toward the inlet end for discharging gas therethrough in a direction counter-current to the direction of movement of the material through the element from the inlet end to the outlet end.

By rearwardly inclining the gas dissipation ports, it is found that the tendency for surface fibers to hang on the port edges is reduced, providing freer movement of the tow. Another beneficial effect of the rearwardly inclined ports is to assist in bending back the edges of the tow fibers as discussed in U.S. Pat. No. 4,390,031 thereby further improving the surface characteristics of the product.

The most critical section of the apparatus is where gas dissipation commences (adjacent the inlet end) at which point gas at relatively high velocity is to be released from the apparatus. As gas dissipation proceeds along the length of the apparatus, the inclination of the ports becomes less critical and the apparatus may include downstream rings of ports which are perpendicular to the direction of movement of the tow.

In accordance with a further feature of the invention, in order to improve the distribution of gas dissipation ports around the volume of the conduit element used for gas discharge, the ports in adjacent rings may be circumferentially set at an angle of offset which is less than the angle between adjacent ports in a ring, so as to provide substantially helically extending lines of the ports lengthwise of the conduit.

The apparatus of the invention may be incorporated in a conduit element which also includes steam admission ports downstream of the gas dissipation ports.

Apparatus in accordance with the invention is particularly useful in processes for manufacturing small size filter rods for cigarettes and the like, as disclosed in U.S. Pat. No. 4,390,031, but it can also be used to advantage in the processes previously noted for manufacturing the larger wicking materials. It may also be applied in other manufacturing processes requiring gas release from a pneumatic conveying conduit where similar considerations are prevalent.

Additional features and advantages of the invention will be apparent from the following description and claims read in conjunction with the accompanying drawings.

DESCRIPTION OF THE PREFERRED EMBODIMENTS

Figures 1, 2, 3, 4, 5, 6:
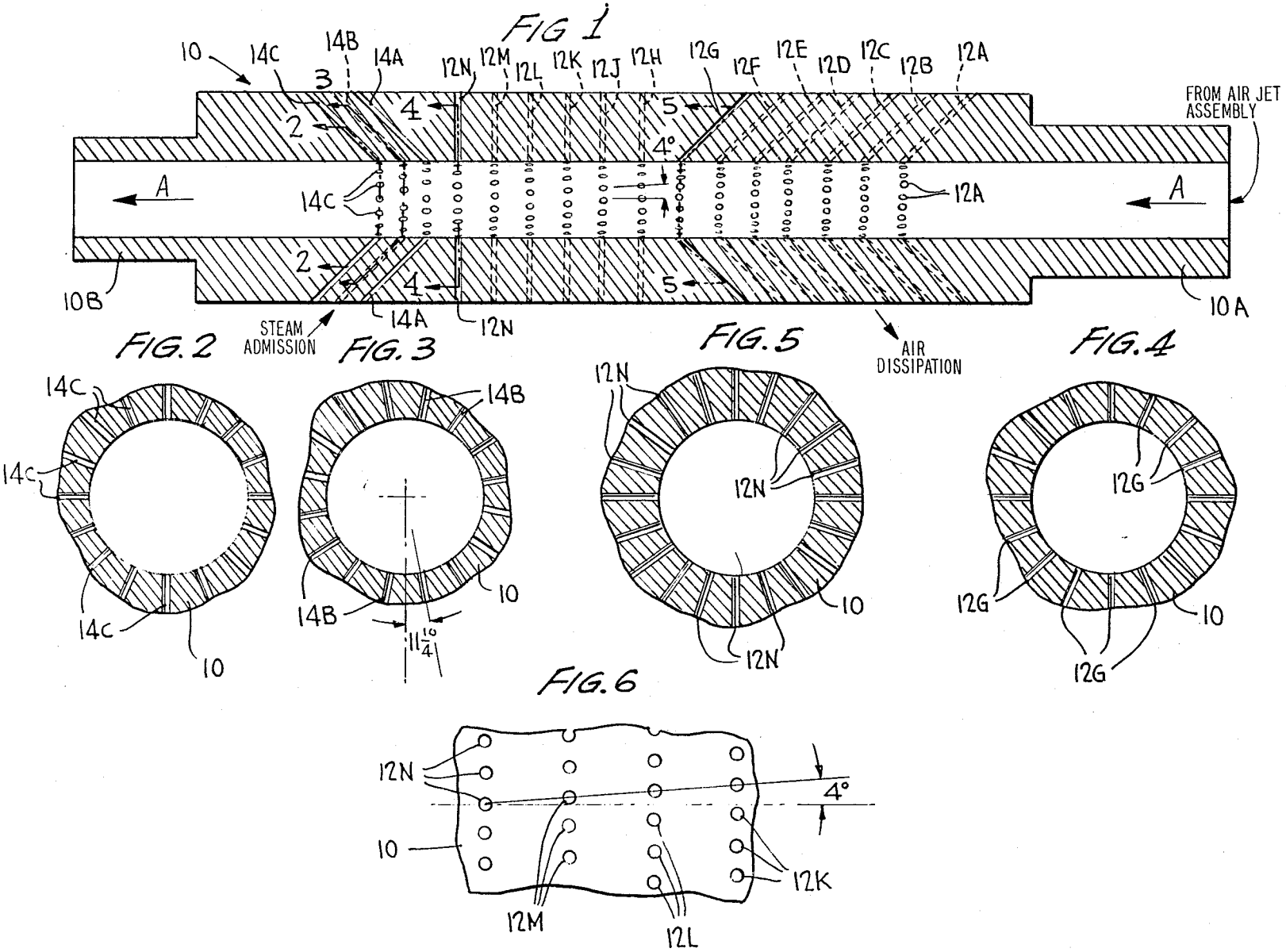
FIG. 1 is a sectional elevational view through gas dissipation apparatus in accordance with the invention.
FIGS. 2–5 are sectional views respectively on lines 2—2, 3—3, 4—4, and 5—5 of FIG. 1.
FIG. 6 is an enlarged view of a part of the interior surface of the apparatus.

The illustrated apparatus comprises a conduit element 10 particularly suitable for use as a fiber separator (gas dissipation apparatus) in a process for making filter rods from a fibrous tow wherein the tow is conveyed pneumatically in a conduit through a variety of processing stations. For example, the apparatus may be used in connection with the process which is particularly described in U.S. Pat. No. 4,390,031 wherein the fibrous tow is conveyed pneumatically through a conduit 60 (referring to FIG. 9 in particular of the patent drawings) by means of a venturi-type air jet assembly 64, a major part of the conveying air subsequently being discharged from the conduit through a porous portion 74 thereof prior to the introduction of steam to the tow for bonding same to form a filter rod. The apparatus illustrated in the patent is particularly adapted to low-volume air flow suitable for conveying a tow for a small size cigarette-type filter rod, and apparatus 10 in accordance with the present invention may be used in the patented process in place of porous portions 74 of conduit 60 (and the subsequent steaming means) as a means for optimizing the air dissipation and improving the surface characteristics of the tow as previously discussed.

Conduit element 10 has an inlet 10A and an outlet end 10B considered in the direction of conveyance of the tow therethrough, indicated by arrows A and in the illustrated embodiment the ends are of reduced outside diameter (for example, for connection into conduit 60 above) although this is not essential.

Between its inlet and outlet ends, conduit element 10 has a series of axially spaced rings of circumferentially spaced air dissipation ports 12A–12N. Rings of ports 12A–12G adjacent the inlet end 10A of the conduit element are inclined rearwardly with respect to the intended direction of travel of a tow from the inlet end to the outlet end, so as to provide air dissipation through the ports in a counter-current direction to the travel of the tow with a view to reducing the tendency for tow fibers to hang on these ports and to increase the tendency for the fibers to become bent back at their edges. The angle of rearward inclination of the respective ports may be about 45° and there may be twenty (20) ports per ring each of about 1/32" in diameter, although these parameters may be varied for particular applications.

Downstream rings of dissipation ports 12H–12N may also be provided in the conduit element, the downstream ports being oriented perpendicularly to the direction of travel of the tow. As previously described, the reason that the downstream ports may be perpendicularly oriented is that counter-current release of the conveying gas is found to be less critical after initial release of the high velocity gas. The downstream rings of gas dissipation 12H–12N may have sixteen (16) ports per ring, each of about 0.035" in diameter.

The conduit element 10 may also include rings of steam admission ports 14A–14C downstream from the gas dissipation ports, the steam ports being angled (for example at 45°) for counter-current injection of steam into the tow, and in the case of the process illustrated in U.S. Pat. No. 4,390,031, taking the place of steam ports 80. There may, for example, be sixteen (16) ports, each of 1/32" in diameter in each steam ring.

In order to provide optimum distribution of gas dissipation ports around the volume of the conduit element used for gas dissipation, the individual ports in the respective rings 12A–12N may be respectively offset circumferentially in adjacent rings at an angle of offset (for example, about 4°) which is less than the angle between the adjacent ports in a ring, as shown most clearly in FIG. 6, whereby substantially helically extending lines of the ports are provided. The ports in the steam admission rings 14A–14C may be similarly offset ring-to-ring at an angle of about 4°".

While the apparatus has been described in particular for application in the process disclosed in U.S. Pat. No. 4,390,031, it is not limited thereto and numerous modifications can be made within the scope of the appended claims.

I claim:

1. In an apparatus for the manufacture of filter rod material from a fibrous tow including a conduit means through which the tow is to be conveyed pneumatically to a steam injection station, gas injection means for delivering conveying gas to the conduit means for conveying the tow therethrough in one direction of travel, and a gas dissipation means for discharging the gas from the conduit means downstream from the injection means, the improvement wherein the gas dissipation means includes at least one ring of circumferentially spaced gas dissipation ports in the conduit means adapted for reducing the tendency of tow fibers to hang on said ports and increasing the tendency of the fibers to become bent back at their edges, said ports being inclined rearwardly for outflow of gas from the conduit means in a second direction which is counter-current to the direction of travel of the tow through the conduit means.

2. The improvement as defined in claim 1 including plural axially spaced rings of gas dissipation ports inclined as aforesaid wherein the individual ports in adjacent rings are offset circumferentially at an angle which is less than the angle between adjacent ports in a ring.

3. In an apparatus for the manufacture of filter rod material from a fibrous tow including a conduit means through which the tow is to be conveyed pneumatically to a steam injection station, gas injection means for delivering conveying gas to the conduit means for conveying the tow therethrough in one direction of travel, and a gas dissipation means for discharging the gas from the conduit means downstream from the injection means, the improvement wherein the gas dissipation means includes at least one ring of circumferentially spaced gas dissipation ports in the conduit means inclined rearwardly for outflow of gas from the conduit means in a second direction which is counter-current to the direction of travel of the tow through the conduit means wherein said at least one ring of gas dissipation ports is followed in the direction of travel of the tow by at least one further ring of circumferentially spaced gas dissipation ports perpendicularly oriented with respect to the direction of travel of the tow.

4. The improvement as defined in claim 3 wherein the individual ports in adjacent rings are offset circumferentially at an angle which is less than the angle between adjacent ports in a ring.

* * * * *